US005998734A

United States Patent [19]

Kerestan et al.

[11] Patent Number: 5,998,734

[45] Date of Patent: Dec. 7, 1999

[54] COVER FOR AN ELECTRICAL RECEPTACLE

[75] Inventors: Aaron R. Kerestan, Kendallville; Frank Roe, Wolcottville, both of Ind.

[73] Assignee: Pent Products, Inc., Kendallville, Ind.

[21] Appl. No.: 09/022,944

[22] Filed: Feb. 12, 1998

[51] Int. Cl.[6] ..... H01H 9/02

[52] U.S. Cl. ..... 174/53; 174/54; 174/65 R; 439/650

[58] Field of Search ..... 174/53, 54, 60, 174/65 R; 439/934, 650, 107, 892

[56] References Cited

U.S. PATENT DOCUMENTS

| | | | |
|---|---|---|---|
| 1,633,668 | 6/1927 | Ile . | |
| 2,091,773 | 8/1937 | Travers | 173/330 |
| 2,214,065 | 9/1940 | Pennock et al. | 439/516 |
| 2,908,743 | 10/1959 | Premoshis | 174/53 |
| 3,022,485 | 2/1962 | Buchanan | 439/466 |
| 3,054,994 | 9/1962 | Haram | 340/326 |
| 3,059,045 | 10/1962 | Swartwood | 174/53 |
| 3,112,973 | 12/1963 | Von Holtz | 439/456 |
| 3,403,217 | 9/1968 | Drapkein | 174/53 |
| 3,403,218 | 9/1968 | Norden | 174/53 |
| 3,526,703 | 9/1970 | Tucker | 174/53 |
| 3,728,468 | 4/1973 | Grauer | 174/51 |
| 3,858,161 | 12/1974 | Champion et al. | 339/122 R |
| 4,059,327 | 11/1977 | Vann | 339/122 R |
| 4,105,862 | 8/1978 | Hoehn | 174/53 |
| 4,163,137 | 7/1979 | Close, Jr. | 200/302 |
| 4,343,527 | 8/1982 | Harrington et al. | 339/125 R |
| 4,767,359 | 8/1988 | Martell | 439/535 |
| 4,837,406 | 6/1989 | Emmons | 174/57 |

FOREIGN PATENT DOCUMENTS

| | | | |
|---|---|---|---|
| 673191 | 10/1963 | Canada | 174/53 |

*Primary Examiner*—Dean A. Reichard
*Assistant Examiner*—Dhiru R Patel
*Attorney, Agent, or Firm*—Taylor & Associates, P.C.

[57] ABSTRACT

An electrical outlet assembly includes an electrical receptacle having a body with a face. At least one female plug is associated with the face, and at least two exposed terminals are associated with each plug. Each exposed terminal is connected with and carried by the body. A cover is separate from and removably coupled with the electrical receptacle and substantially entirely covers at least one exposed terminal.

15 Claims, 2 Drawing Sheets

COVER FOR AN ELECTRICAL RECEPTACLE

BACKGROUND OF THE INVENTION

1. Field of the Invention

The present invention relates to electrical receptacles, and, more particularly, to electrical receptacles having exposed terminals.

2. Description of the Related Art

Electrical receptacles, such as conventional duplex receptacles, typically include a plurality of female plugs having blade receiving sockets which receive corresponding blades of a male plug connected with an electrical load, such as a light fixture, computer, appliance, etc. Each blade receiving socket of each female plug is connected with at least one exposed terminal on the sides and/or back of the electrical receptacle. For example, a three-prong female plug of a duplex receptacle typically includes a line conductor associated with an exposed screw type terminal and an exposed push-in type terminal, a neutral conductor associated with an exposed screw type terminal and a push-in type terminal, and a ground conductor associated with an exposed ground terminal. The exposed ground terminal of course by itself does not pose a concern. However, the exposed line terminals and the exposed neutral terminals, and particularly the exposed line terminals, may pose a concern. For example, an electrician may unwisely remove the electrical receptacle from an outlet box while the receptacle is still "hot". If the electrician inadvertently grasps the opposing sides of the electrical receptacle where the exposed line and neutral terminals are located, a potential concern may exist if the receptacle is still hot.

What is needed in the art is an electrical outlet assembly which is configured such that the exposed electrical terminals are covered during use after the electrical receptacle is hardwired with appropriate electrical wires.

SUMMARY OF THE INVENTION

The present invention provides a cover for an electrical receptacle which entirely covers the exposed terminals of the receptacle. The cover is coupled with the receptacle through engagement with electrical wires attached to the terminals and/or is attached directly to the body of the receptacle.

The invention comprises, in one form thereof, an electrical outlet assembly including an electrical receptacle having a body with a face. At least one female plug is associated with the face, and at least two exposed terminals are associated with each plug. Each exposed terminal is connected with and carried by the body. A cover is separate from and removably coupled with the electrical receptacle and substantially entirely covers at least one exposed terminal.

An advantage of the present invention is that the exposed terminals of the receptacle are covered when connected with electrical wires.

Another advantage is that the cover may be quickly and relatively easily attached and detached from the receptacle.

Yet another advantage is that the cover may be coupled with the receptacle either by engagement with the electrical wires attached to the terminals and/or by direct attachment with the receptacle.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
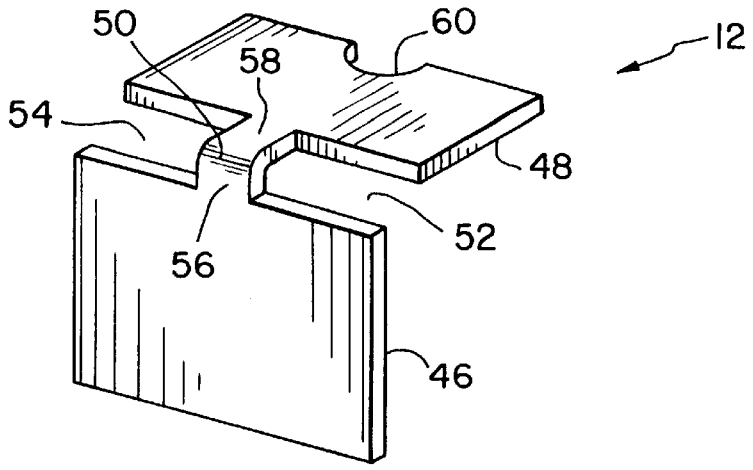
FIG. 1 is a perspective view of an embodiment of a cover of the present invention for covering the exposed terminals of an electrical receptacle.
Figure 2:
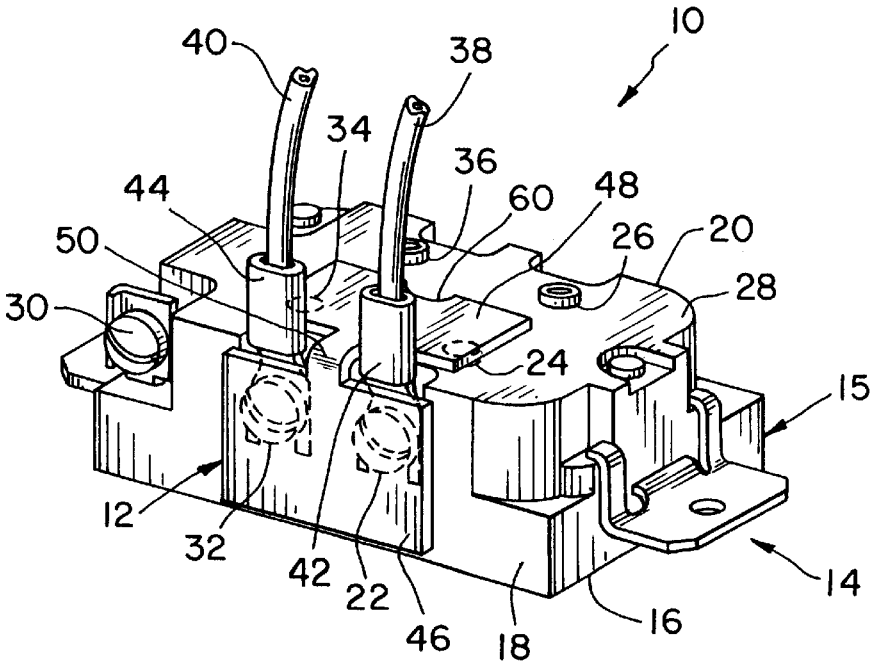
FIG. 2 is a perspective view of an embodiment of an electrical outlet assembly of the present invention including the cover of FIG. 1.

Referring now to the drawings, and more particularly to FIGS. 1–2, there is shown an embodiment of an electrical outlet assembly 10 of the present invention including an embodiment of a cover 12 of the present invention coupled with an electrical receptacle 14. Cover 12 overlies and thereby covers at least a portion of the exposed terminals of electrical receptacle 14, as will be described in greater detail hereinafter.

Electrical receptacle 14 includes a body 15 having a face 16, opposing sides 18 and 20, and a back wall 28. Electrical receptacle 14, in the embodiment shown, is a standard duplex receptacle with a pair of three-prong female plugs (not shown) on face 16 thereof. Each three-prong plug, in known manner, includes at least one line terminal, at least one neutral terminal and a ground terminal associated therewith. In the embodiment shown, electrical receptacle 14 includes a first female plug associated with two screw type terminals mounted on respective opposing sides 18 and 20 (one of which is shown in phantom lines and referenced as 22), and two push-in type terminals 24 and 26 on a back wall 28 of electrical receptacle 14. Exposed screw type terminal 22 and exposed push-in type terminal 24 are connected with the line conductor of the first female plug, and the opposing screw type terminal (not shown) and push-in type terminal 26 are connected with the neutral conductor of the first female plug. An exposed ground terminal 30 is connected in parallel with the ground conductor of each three-prong plug in known manner. Similarly, screw type terminal 32, push-in type terminals 34 and 36, and an opposing screw type terminal on opposing sidewall 20 (not shown) are connected with respective line and neutral conductors of the other three-prong female plug on face 16 of electrical receptacle 14. Screw type terminals 22 and 32 on side 18, and the pair of screw type terminals on opposing side 20, may be connected together with a jumper or may be electrically isolated from each other, in known manner. For example, screw type terminals 22 and 32, and the screw type terminals on the opposing sidewall 20 may be respectively connected together if the female plugs of each electrical receptacle 14 in the wiring arrangement are to be connected in parallel, or may be electrically isolated from each other if at least one of the plugs on each electrical receptacle 14 is connected in a switched wiring arrangement.

A pair of electrical conductors or wires 38 and 40 are respectively attached to screw type terminals 22 and 32 using spade terminals 42 and 44. If screw type terminals 22 an 32 are connected in parallel with each other, wire 38 may be connected to a source of electrical power, while wire 40 may be connected to a corresponding terminal of another electrical receptacle 14 in the wiring arrangement.

Cover 12 is separate from and removably coupled with electrical receptacle 14. Cover 12 includes a first leg 46 and a second leg 48 which are connected and disposed substantially perpendicular to each other. First leg 46 and second leg 48 define an adjoining edge 50 therebetween with a radius of curvature allowing cover 12 to bend around and overlie a portion of back wall 28 and one of sidewalls 18 and 20. Two cutouts 52 and 54 are formed in each of first leg 46 and second leg 48. That is, first leg 46 and second leg 48 each include a respective center extension 56 and 58 which extends to adjoining edge 50. A portion of each of first leg 46 and second leg 48 is therefore removed to define cutouts 52 and 54. Cutouts 52 and 54 are associated with respective screw type terminals 22 and 32. Accordingly, cutouts 52 and 54 are sized and shaped to allow wires 38 and 40 to pass therethrough for connection with screw type terminals 22 and 32. Second leg 48 includes a semi-circular cutout 60 which is sized and shaped to accommodate a corresponding projection which may extend from a back wall of some known electrical receptacles.

Cover 12, including first leg 46 and second leg 48, in the embodiment shown in FIGS. 1 and 2, is formed from a plastic material which is somewhat elastic. Accordingly, after wires 38 and 40 are attached to respective screw type terminals 22 and 32, first legs 46 and 48 may be bent and/or moved relative to each other to an extent which allows cover 12 to be slid between and over wires 38 and 40 until cover 12 lies adjacent to electrical receptacle 14. When in the position shown in FIG. 2, cover 12 overlies and thereby substantially entirely covers exposed terminals 22, 24, 32 and 34 of electrical receptacle 14. Second leg 48 of cover 12 does not extend past the longitudinal center of electrical receptacle 14, such that a second cover 12 may be used to overlie and thereby cover push-in type terminals 26 and 36 and the screw type terminals on sidewall 20.

After cover 12 is placed against electrical receptacle 14 such that each of wires 38 and 40 are disposed within respective cutouts 52 and 54, cover 12 is held in place and thereby coupled with electrical receptacle 14 by wires 38 and 40. Cover 12 may be removed from electrical receptacle 14 by again flexing first leg 46 and/or second leg 48 about adjoining edge 50 such that cutouts 52 and 54 either simultaneously or sequentially open to allow cover 12 to be removed.

Figure 3:
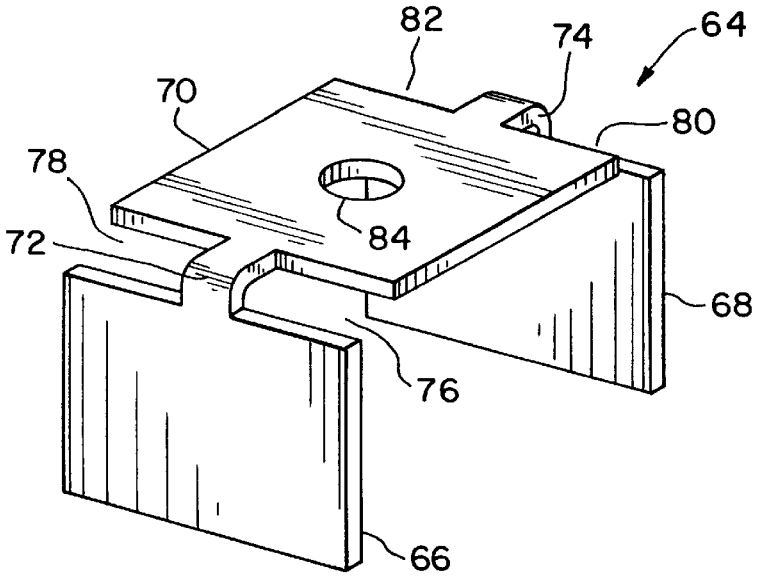
FIG. 3 is a perspective view of another embodiment of a cover of the present invention for covering the exposed terminals of an electrical receptacle.
Figure 4:
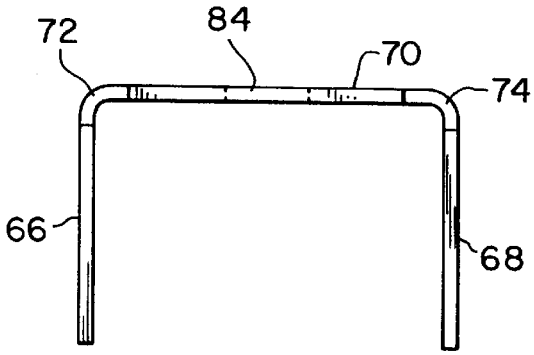
FIG. 4 is a side view of the cover of FIG. 3.
Figure 5:
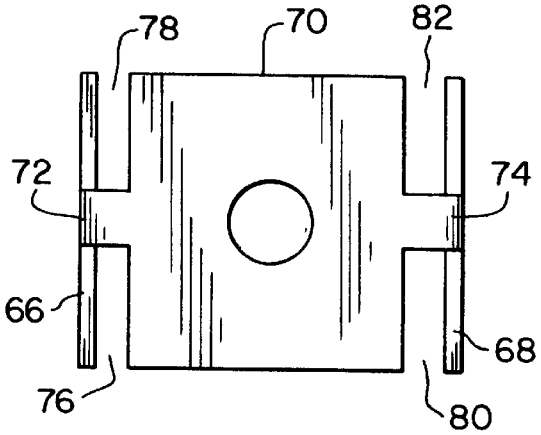
FIG. 5 is a top view of the cover of FIGS. 3 and 4.

Referring now to FIGS. 3–5, there is shown another embodiment of a cover 64 of the present invention for use with an electrical receptacle, such as electrical receptacle 14 shown in FIG. 2. Cover 64 includes a first leg 66 and a second leg 68 which are interconnected with each other via a center interconnecting portion 70. First leg 66 and second leg 68 are disposed substantially parallel to each other and perpendicular to interconnecting portion 70. First leg 66 and interconnecting portion 70 define a first adjoining edge 72 therebetween, and second leg 68 and interconnecting portion 70 define a second adjoining edge 74 therebetween. Cover 64 includes four cutouts associated with respective screw type terminals of an electrical receptacle, with two cutouts 76 and 78 associated with adjoining edge 72, and two remaining cutout 80 and 82 associated with second adjoining edge 74. Interconnecting portion 70 includes a circular cutout 84 for receiving a projection which may extend from a back wall 28 of electrical receptacle 14.

During use, first leg 66, second leg 68 and interconnecting portion 70 are flexed relative to each other about first adjoining edge 72 and/or second adjoining edge 74 such that four corresponding electrical wires connected with screw type terminals of an electrical receptacle 14 may be respectively received within cutouts 76, 78, 80 and 82. When installed on electrical receptacle 14, first leg 66 lies adjacent to side 18 and covers screw type terminals 22 and 32 associated therewith, second leg 68 lies adjacent to side 20 and covers the screw type terminals associated therewith, and interconnecting portion 70 lies adjacent to back wall 28 and covers push-in type terminals 24, 26, 34 and 36 associated therewith. Cover 64 may in one sense be thought of as two covers 12 (shown in FIGS. 1–2) connected to each other along the longitudinal axis of electrical receptacle 14. Thus, cover 64 allows a single cover to be installed on electrical receptacle 14 and thereby cover all of the exposed electrical terminals associated therewith.

Figure 6:
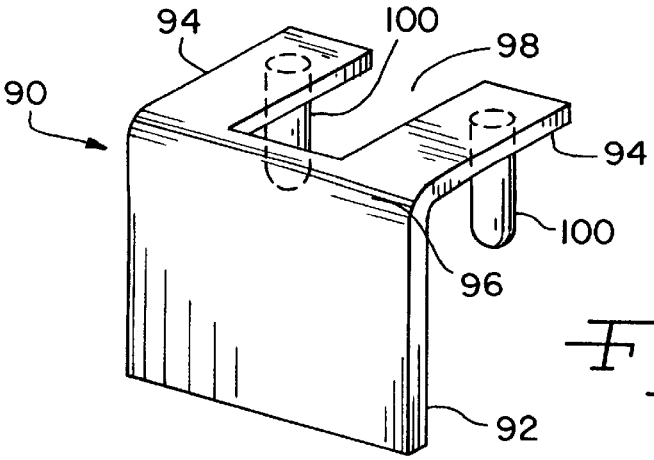
FIG. 6 is a perspective view of yet another embodiment of a cover of the present invention for covering the exposed terminals of an electrical receptacle.

Referring now to FIG. 6, there is shown yet another embodiment of a cover 90 of the present invention for covering the exposed terminals of an electrical outlet, such as electrical outlet 14 shown in FIG. 2. Cover 90 includes a first leg 92 and a second leg 94 which are disposed substantially perpendicular to each other and interconnected along an adjoining edge 96. Second wall 94 includes a cutout 98 therein which is disposed in communication with adjoining edge 96. Cutout 98 allows one or more electrical wires which are connected with screw type terminals of an electrical receptacle to pass therethrough. Rather than being held in place with the electrical receptacle by the interconnection and engagement with the electrical wire (as in the embodiments of covers 12 and 64 shown in FIGS. 1–5), cover 90 includes two projections 100 which extend parallel to each other from second leg 94. Projections 100 are pushed into and thus received within a corresponding pair of push-in type terminals on back wall 28 of electrical receptacle 14. For example, projections 100 may be pushed into push-in type terminals 24 and 34 such that cover 90 overlies each of screw type terminals 22 and 32 and each of push-in type terminals 24 and 34.

In the embodiments shown in the drawings, covers 12, 64 and 90 do not allow wires to be connected with push-in type terminals 24, 26, 34 and 36. However, if desirable for a particular application, it will be appreciated that covers 12 and 64 can be modified to allow use of push-in type terminals 24, 26, 34 and 36 by forming respective cutouts in second leg 48 or interconnecting portion 70. In fact, if covers 12 and 64 are formed from a material having suitable electrically insulating properties, covers 12 and 64 can in fact be held in place and thus coupled with electrical receptacle 14 by placing electrical wires through the cutouts in second leg 48 or interconnecting portion 70 and into the corresponding push-in type terminals 24, 26, 34 and 36. When stripped to an appropriate length, electrical insulation surrounding electrical wires would thus abut second leg 48 or interconnecting portion 70 to hold covers 12 and 64 in place adjacent to electrical receptacle 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical outlet assembly, comprising:

an electrical receptacle having a body with a face, at least one female plug associated with said face, said body including opposing sides with each said side being adjacent to said face, said electrical receptacle including at least two exposed terminals associated with said at least one plug, each of said exposed terminals being mounted on a respective one of said opposing sides; and a cover separate from and removably coupled with said electrical receptacle, said cover overlying and thereby substantially entirely covering at least one of said exposed terminals, said cover being substantially L-shaped with a first leg and a second leg, each of said first leg and said second leg being disposed substantially perpendicular to each other and defining an adjoining edge therebetween, said cover further including at least one cutout in at least one of said first leg and said second leg, each said at least one cutout being in communication with said adjoining edge.

2. The electrical outlet assembly of claim 1, wherein said at least one cutout comprises two cutouts.

3. The electrical outlet assembly of claim 1, further comprising two electrical wires associated with said at least one plug, each said wire being connected with a respective one of said exposed terminals and disposed within a respective one of said cutouts.

4. The electrical outlet assembly of claim 1, wherein one of said cutouts is associated with a corresponding one of said exposed terminals.

5. An electrical outlet assembly, comprising:

an electrical receptacle having a body with a face, at least one female plug associated with said face, said body including opposing sides with each said side being adjacent to said face, said electrical receptacle including at least two exposed terminals associated with said at least one plug, each of said exposed terminals being mounted on a respective one of said opposing sides; and a cover separate from and removably coupled with said electrical receptacle, said cover overlying and thereby substantially entirely covering at least one of said exposed terminals, said cover being substantially U-shaped with a first leg, a second leg and an interconnecting portion, each of said first leg and said second leg being disposed substantially parallel to each other and perpendicular to said interconnecting portion, said interconnecting portion and said first leg defining a first adjoining edge therebetween, said interconnecting portion and said second leg defining a second adjoining edge therebetween, said cover further including at least two cutouts, each said cutout being associated and in communication with one of said first adjoining edge and said second adjoining edge.

6. The electrical outlet assembly of claim 5, wherein said at least two cutouts comprise four cutouts, two of said four cutouts being associated with said first adjoining edge and a remaining two of said four cutouts being associated with said second adjoining edge.

7. The electrical outlet assembly of claim 5, further comprising two electrical wires associated with said at least one plug, each said wire being connected with a respective one of said exposed terminals and disposed within a respective one of said cutouts.

8. The electrical outlet assembly of claim 5, wherein each said cutout is associated with a corresponding one of said exposed terminals.

9. An electrical outlet assembly, comprising:

an electrical receptacle having a body with a face, at least one female plug associated with said face, said body including opposing sides with each said side being adjacent to said face, said electrical receptacle including at least two exposed terminals associated with said at least one plug, each of said exposed terminals being connected with and carried by said body, wherein said at least two exposed terminals comprise two screw type terminals and two push-in type terminals associated with; and a cover separate from and removably coupled with said electrical receptacle, said cover overlying and thereby substantially entirely covering at least one of said exposed terminals.

10. The electrical outlet assembly of claim 9, wherein said cover includes two projections which are respectively coupled with said two push-in type terminals.

11. A cover for use with an electrical receptacle having a body with a face, at least one female plug associated with the face, and at least two exposed terminals associated with said at least one plug, each exposed terminal being connected with and carried by the body, said cover comprising:

a first leg and a second leg connected together, at least one of said first leg and said second leg being configured for removable coupling with the electrical receptacle, at least one of said first leg and said second leg being configured for substantially entirely overlying and thereby covering at least one corresponding exposed terminal of the electrical receptacle.

12. The cover of claim 11, wherein said cover is substantially L-shaped, each of said first leg and said second leg being disposed substantially perpendicular to each other and defining an adjoining edge therebetween, said cover further including at least one cutout in at least one of said first leg and said second leg, each said cutout being in communication with said adjoining edge.

13. The cover of claim 12, wherein said at least one cutout comprises two cutouts.

14. The cover of claim 11, wherein said cover is substantially U-shaped with an interconnecting portion which interconnects each of said first leg and said second leg, each of said first leg and said second leg being disposed substantially parallel to each other and perpendicular to said interconnecting portion, said interconnecting portion and said first leg defining a first adjoining edge therebetween, said interconnecting portion and said second leg defining a second adjoining edge therebetween, said cover further including at least two cutouts respectively associated and in communication with said first adjoining edge and said second adjoining edge.

15. The cover of claim 14, wherein said at least two cutouts comprise four cutouts, two of said four cutouts being associated with said first adjoining edge and a remaining two of said four cutouts being associated with said second adjoining edge.

* * * * *